US005465448A

United States Patent [19]

Tajima et al.

[11] Patent Number: 5,465,448

[45] Date of Patent: Nov. 14, 1995

[54] PIPE INTERIOR CLEANING APPARATUS

[75] Inventors: Itsuho Tajima, Tokyo; Yoshitaka Tajima, Koshigaya, both of Japan

[73] Assignee: Tajima Denken Co., Ltd., Koshigaya, Japan

[21] Appl. No.: 995,571

[22] Filed: Dec. 22, 1992

[30] Foreign Application Priority Data

Dec. 27, 1991 [JP] Japan ..... 3-347548

[51] Int. Cl.[6] ..... B08B 9/02

[52] U.S. Cl. ..... 15/104.31; 15/104.07; 15/104.16

[58] Field of Search ..... 15/104.05, 104.07, 15/104.16, 104.2, 104.31

[56] References Cited

U.S. PATENT DOCUMENTS

| | | | |
|---|---|---|---|
| 577,765 | 2/1897 | Lockwood et al. | 15/104.07 |
| 1,117,192 | 11/1914 | Kelly | 15/104.16 |
| 1,611,820 | 12/1926 | Delo . | |
| 1,875,413 | 9/1932 | Braly | 15/104.16 |
| 2,261,687 | 11/1941 | Lowry | 15/104.16 |
| 2,402,314 | 6/1946 | Crane | 15/104.31 |
| 2,808,852 | 10/1957 | Brant . | |
| 2,991,493 | 7/1961 | Haas . | |
| 3,108,302 | 10/1963 | Whiteis | 15/104.16 |
| 4,462,430 | 7/1984 | Anthony et al. | 15/104.16 |

FOREIGN PATENT DOCUMENTS

| | | | |
|---|---|---|---|
| 60-193287 | 12/1985 | Japan . | |
| 62-247881 | 10/1987 | Japan . | |
| 1-262976 | 10/1989 | Japan . | |
| 2-1289 | 1/1990 | Japan . | |
| 2-63589 | 3/1990 | Japan . | |
| 3-161086 | 7/1991 | Japan . | |
| 3-202185 | 9/1991 | Japan . | |
| 368434 | 5/1963 | Switzerland | 15/104.31 |
| 975067 | 11/1964 | United Kingdom . | |
| 2115101 | 9/1983 | United Kingdom . | |

*Primary Examiner*—Edward L. Roberts
*Attorney, Agent, or Firm*—Rosen, Dainow & Jacobs

[57] ABSTRACT

The present invention provides a pipe interior cleaning apparatus which can be operated at an inexpensive cost and with no special facility required, assuring an improved derusting effect. This pipe interior cleaning apparatus comprises a rod-like guide, knobs provided at opposite ends of said guide, and a cleaning member into which said guide is inserted and which is made to be slidable along said guide.

10 Claims, 5 Drawing Sheets

PIPE INTERIOR CLEANING APPARATUS

BACKGROUND OF THE INVENTION

The present invention relates to a cleaning apparatus for use to remove a variety of sediments and rusts which might be created inside a pipe.

In installing telephone cables etc. in the earth, they are often laid by threading through existing steel pipes and cast pipes etc. which have been buried in the underground at the depth of 2–5 meters.

However, as an aging action after the laying of the pipes, a corrosion may take place inside such pipes, or deformation and detachment of such pipes may occur, and thereby making it difficult to thread the cables through the pipes. There are increasing cases that metal cables with greater diameters are used to meet an increasing demand by a telecommunication network, and thus cables may be prevented from being installed unless above-described problem inside the pipe is eliminated.

In this connection, it has been found that about 60% cases of troubles in which cables are prevented from being threaded through the pipes are attributable to a corrosion development inside the pipe, particularly on a joint area between adjacent pipes. Such corrosion may build-up on the pipe interior, and thus it may act to narrow down the pipe internal diameter.

Under such a situation, it has been customary in a prior art to take a continuity test initially so as to check for a presence of any abnormality inside the pipe, when new cables are to be installed in existing pipes, as described below.

This test is carried out in accordance with a prior art procedure illustrated in FIG. 10 wherein a wire 62 is connected with a mandrel 61 having a diameter slightly smaller than the internal diameter of the pipe, and then the mandrel 61 is inserted from a manhole into a horizontal pipe 60, as shown. The mandrel 61 is moved in one direction by pulling the wire 62, and then an inspection is made as to the presence of any abnormality inside the pipe 60. If the mandrel 61 can smoothly pass through the pipe 60 without any obstacle, it may be judged that the pipe retains its proper diameter, and thus additional cables may be installed smoothly.

On the contrary, if the mandrel 61 is prevented from advancing further or is immovable in any way, one can judge that the pipe internal diameter is narrowed down for the reason of some abnormality such as the corrosion development etc.

Traditionally, if it is suspected that the pipe interior may be corroded, then a remedial measure is taken in accordance with a procedure as described below in order to remove such corrosive build-up.

First, a pipe is threaded through an existing pipe, and then a high-pressure water stream (water jet) is injected from this pipe to wash away rust.

Secondly, a wire is connected with metallic or fiber brush, and the resultant assembly is then inserted into the pipe through a manhole. By pulling out one of the wires, the brush is caused to move through the pipe and thereby removing the rust which are created on the pipe interior surface.

However, the first method of using a high-pressure water stream has suffered from a problem that it requires a large capacity facility adequate to generate a water stream, and thus it entails a substantial amount of cost. Additionally, the prior art method was also problematic in that rusty materials were left unremoved from the pipe, since the water stream is deficient in removing large-sized rust. A further disadvantage of this method is that it needs a pipe camera to be inserted into the pipe to take a picture of the pipe interior and display it on a monitor screen to allow an operator to confirm the removal of rust.

The second method using the brush does not require any large capacity facility for use to remove the corrosion, and thus the method can be practised with less cost. Moreover, even a unskilled operator may carry out this procedure in a straightforward manner. However, this method is disadvantageous in that the rust which have been built-up in the pipe may not be removed perfectly merely utilizing frictional forces of the brush, and thus this method is often ineffective to increase and restore the pipe internal diameter to that as needed by the cable to be inserted.

Where a large quantity of rust is left unremoved in the pipe even after the cleaning operation was carried out in accordance with the procedure as above described, trouble-shooting procedures should be taken such as the re-excavation and repair of the pipe, replanning of the pipe laying route, and replacement of pipes being adopted etc. Consequently, a work period may be extended, which results in disadvantageously increased installation cost.

A particularly serious problem occurring from those prior arts is that an operator may not identify easily whether a corrosion development or any other phenomenon is a possible cause for narrowing down the pipe diameter. As a result, it frequently becomes necessary to use inexpensive pipe camera or carry out a cumbersome reexcavation operation in order to discriminate a cause by which the pipe diameter has been narrowed down.

SUMMARY OF THE INVENTION

The present invention has been made with the above-described as a background. One object is to provide a pipe interior cleaning apparatus which may dispense with a large-capacity facility and can be operated straightforwardly.

A second object is to provide a pipe interior cleaning apparatus which may ensure an improved derusting operation.

A third object is to provide a cleaning apparatus which may eliminate obstacling material in the pipe during a continuity test of the pipe.

A fourth object is to provide a cleaning apparatus by which a cause for narrowing down the pipe diameter may be readily known.

The present invention has been made with the construction as described hereinbelow, in order to achieve the above objects. Accordingly, a cleaning apparatus is provided in accordance with the present invention, said apparatus comprising a guide which freely slidably passes through the apparatus, a traction device which is connected with opposite ends of said guide, and at least two stops which are provided at a certain spacing therebetween around the outer circumference of said guide, said apparatus made to be movable along the guide between said two stops.

This guide may optionally be provided at its opposite ends with a knob for facilitating a connection of an operating wire. This guide may also be formed in the configuration of round or angular rod or bar, and preferably in the configuration wherein a projecting strip is provided on its circumferential surface. For example, a male thread may be used as it is. The knob which may be provided at opposite ends of the guide may be formed in any suitable configuration, as long as it may accommodate a traction rope or wire to be connected, and the knob may be formed, for example, in a ring-like configuration, or it may alternatively be formed in the configuration of hook as a pulling or traction means.

The cleaning member may be formed in the configuration of a disk, which normally assumes a shape which coincides with a cross-sectional shape of the pipe, having a flange therearound so as to reduce its circumferential thickness. An edge of the cleaning member may be formed with concave and convex surfaces in the configuration of, for example, serration, so as to ensure an improved cleaning effect. The shape of this cleaning member may be formed to be compatible with the internal configuration of the pipe. Moreover, the cleaning member may alternatively be formed in a cylindrical configuration so as to ensure convenient applicational in the continuity test.

The through-hole may be formed to be larger than the diameter of the guide, such that the disk-shaped cleaning member may be inclined against the guide. This arrangement may make the cleaning apparatus slidable easily inside the pipe.

Stops are provided to project outwardly from the guide, and the portion upon which the stops are arranged may be made greater in diameter than the through-hole. Those stops may be formed integrally with the knob.

The cleaning apparatus of the invention is connected at its knob with a wire etc., and it is made to be movable inside the pipe through manipulation of this wire.

While the cleaning apparatus stops moving when it comes into contact with rust which has built-up to project into the pipe, the guide continues moving further. Subsequently, the stops of the guide, which follow the cleaning member, collide with the cleaning member which has been stopped, and the impact of this collision is transferred to the entire cleaning apparatus, resulting in that rust in contact with the cleaning member may be stripped and removed off.

In such a case that the first collision fails to break off the rust and the cleaning member digs into the rusty deposits, the guide is manipulated to retract in an opposite direction and then move again back to an initial position. The stops are then caused to collide again with the rust. By repeating this operational sequence, a constant impact may be imposed continuously upon an area which has been corroded in the manner of hammer. Thus, the cleaning member may be progressively advanced forward while it is removing rust.

Where the cleaning member may dig deeper into the rust and become difficult to move, the guide would be operated to retract in an opposite direction, and a powerful impact is given to the guide from the reverse direction. In this way, the member is advanced forwardly after a temporary retraction, and the knob is made to collide again with the cleaning member.

This hammerring action which takes place in a continuously repetitive manner serves to remove substantially all rust materials which have been built-up in the pipe interior and arc hard to get rid of through a conventional derusting procedure.

By forming the through-hole of the cleaning apparatus to be larger in diameter than the guide, the cleaning member may be inclined against the guide. Therefore, even if the cleaning member is slightly smaller in diameter than the pipe, the cleaning member may be made to be movable through the pipe without coming into contact with small rusts and debris which are present in the pipe.

In this manner, if there are many pipes available for the advance of the cables, the need of newly installing the pipes is eliminated, and thereby realizing a substantial save on a pipe installation cost. A further advantage is that work can be designed and undertaken using cables of increased diameter in a reliable manner.

Since the cleaning apparatus of the invention doubles the functions of not only cleaning the pipe interior but also allowing the pipe continuity test, an advantage may be derived such that installation work may be undertaken in a prompt manner.

When the pipe is bent or detachment occurs at its joint area, and the cleaning apparatus is barred from being threaded through the pipe even if it is operated as above-described, this allows an operator to substantially know that the pipe diameter has not narrowed down due to the presence of rust. Especially when the cleaning apparatus stops moving suddenly at a certain point, and it can be retracted smoothly in an opposite direction without any obstacle from that standstill position, then it may be felt by an operator that the cleaning member may dig into the rust, and thus it indicates presence of possible cause other than the build-up of rust. In such a case that the apparatus is prevented from moving further due to the rust, it may be felt by an operator that the cleaning apparatus may dig into the rust, and the apparatus may advance gradually passing through the pipe under a hammerring action which takes place in a repetitive manner as above-described. It may thus be permissible for the apparatus to pass through a portion from which the rust has removed.

In this way, the possible cause may be easily identified by knowing how the cleaning apparatus behaves itself at the moment that is stops moving, and consequently an optimum trouble-shooting procedure can be taken immediately to get rid of such a cause.

In an alternative embodiment, the cleaning apparatus of the present invention may comprise a guide which is provided at the cleaning member to go through the member for freely slidable movement, a traction thrust tool which is connected with one end of this guide, and at least two stops which are spaced around the outer circumference of the guide, the cleaning member being made movable along the guide between the two stops.

In this case, the traction thrust tool may be formed in the configuration of a bendable elongate member, and the tool can be provided, for example, as a glass fiber rope which is wound around a coiling machine to be available for supply in a certain length as needed.

The cleaning apparatus of the present invention can be applicable not only for the purpose of removing rusty material, but for getting rid of other contaminations, and therefore the apparatus can find alternative applications in the cleaning operation of the water supply pipes and sewage pipes.

DESCRIPTION OF THE PREFERRED EMBODIMENT

Embodiments of the present invention will be described hereinbelow, with reference to accompanying drawings.

Figure 1:
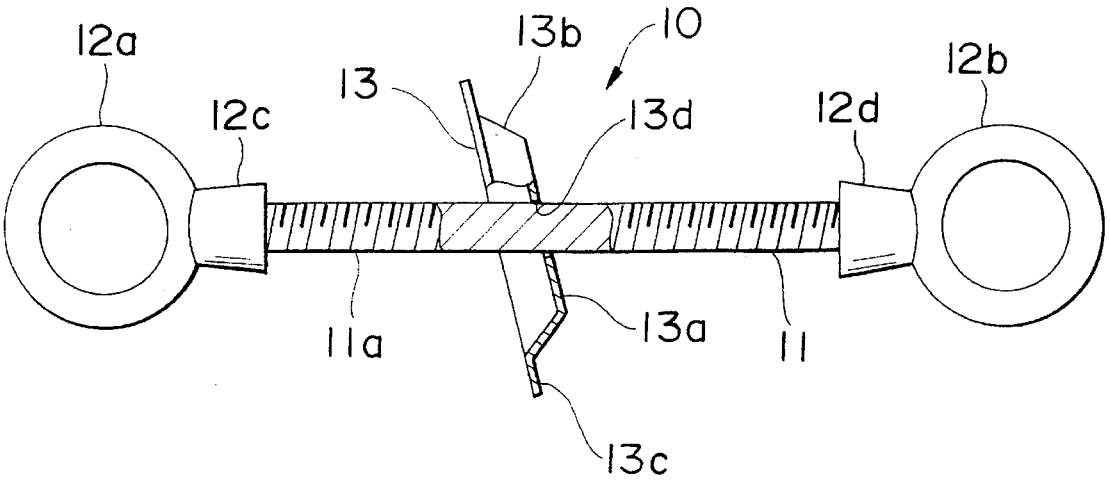
FIG. 1 is a perspective view of a pipe interior cleaning apparatus of the present invention.
Figure 3:
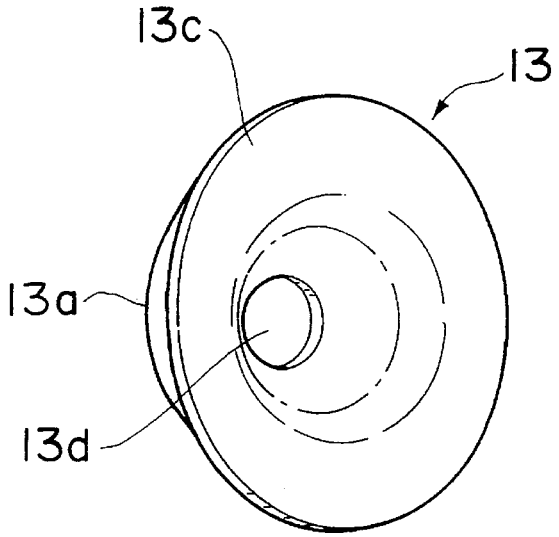
FIG. 3 is a perspective view of a cleaning member.

In FIG. 1, the cleaning apparatus 10 for cleaning the interior of the pipe in accordance with the present invention comprises a rod-shaped guide 11, knobs 12*a* and 12*b* attached at opposite ends of said guide 11, and a derusting disk 13 into which said guide 11 is inserted, and which is slidable along said guide 11 between said knobs 12*a* and 12*b*, said disk 13 being provided as a cleaning member. This derusting disk 13 comprises a disk-shaped portion 13*a*, an opening portion 13*b* of which diameter increases progressively toward a radial outward direction of the disk-shaped portion 13*a* in continuity with this disk-shaped portion 13*a*, and a flange portion 13*c* which projects from the tip of the opening portion 13*b* toward the radial outward direction of the disk-shaped portion 13*a*, said disk 13 being formed generally in the configuration of dish, as shown in FIG. 1 and 3.

Defined in the center of said disk-shaped portion 13*a* is a through-hole 13*d* through which the guide 11 may be inserted. Since the diameter of the through-hole 13*d* is made greater than that of the guide 11, the derusting disk 13 may be made slidable along the guide 11.

The guide 11 is formed with a thread 11*a* which prevents the derusting disk 13 from sliding excessively, and the derusting disk 13 is positioned such that its circumference may be located in a valley between threads 11*a* and 11*a*. Thus, the derusting disk 13 can slide only when a force greater than a predetermined magnitude is imposed upon the derusting disk 13.

The diameter of the flange portion 13*c* at the outer circumference of the derusting disk is formed to be slightly smaller than the inner diameter of the pipe into which the flange is inserted, and consequently the cleaning apparatus can be made to be movable inside the pipe.

This guide 11 is provided at its opposite ends with ring-shaped knobs 12*a* and 12*b* which are arranged symmetrically. The cleaning apparatus can be made movable inside the pipe by pulling wires which are connected with these knobs 12*a* and 12*b* respectively.

Stops 12*c* and 12*d* are provided to be integral with knobs 12*a* and 12*b* at a portion where said knobs 12*a* and 12*b* are jointed with the guide 11, said stops 12*c* and 12*d* each having a vertical plane with the guide 11 respectively.

The derusting disk 13, the guide 11, stops 12*c* and 12*d* are all formed from a hard material selected from an iron, steel and stainless steel which have a predetermined strength for achieving an purpose of removing rust off the pipe interior.

Figure 2:
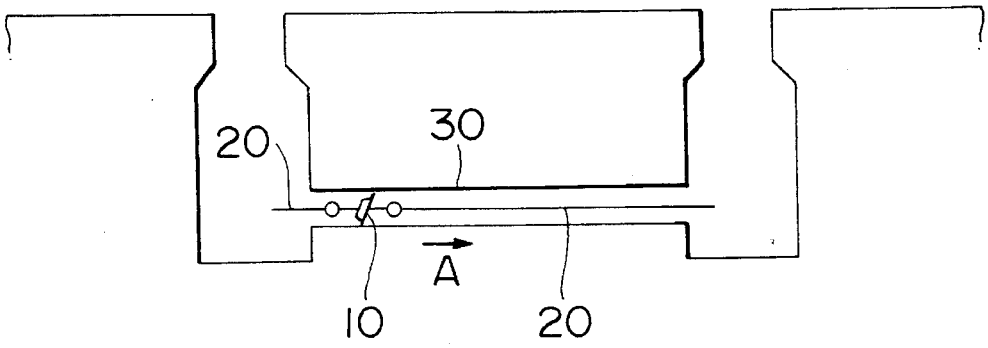
FIG. 2 is a view of the cleaning apparatus when it is inserted into the pipe through the man-hole.
Figure 4:
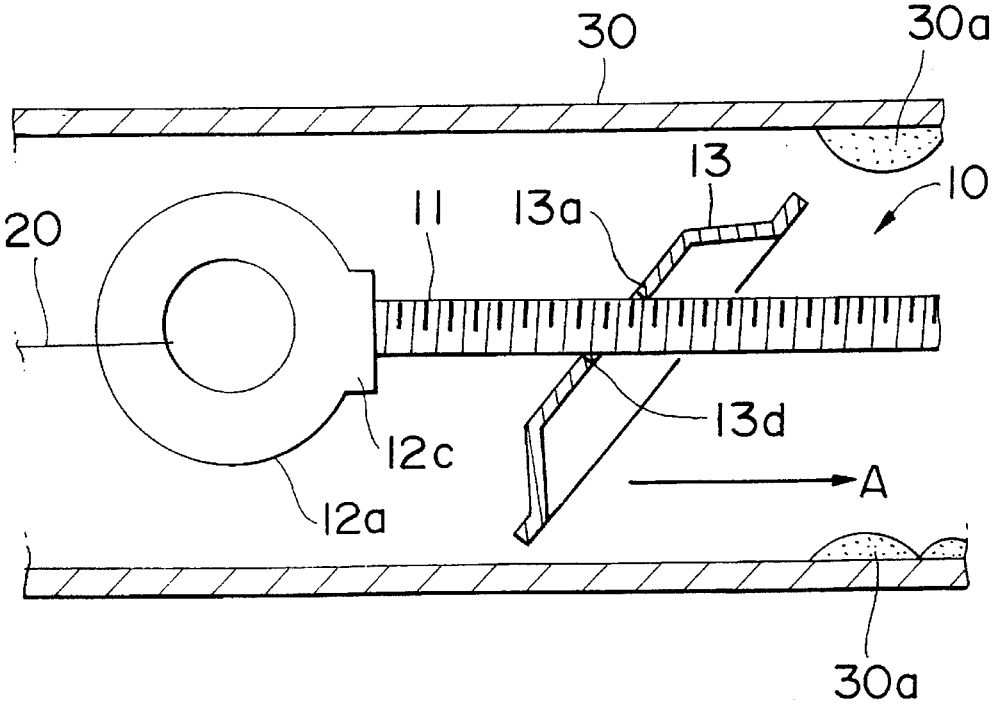
FIG. 4 is view of the cleaning apparatus while it is moving through the pipe.
Figure 5:
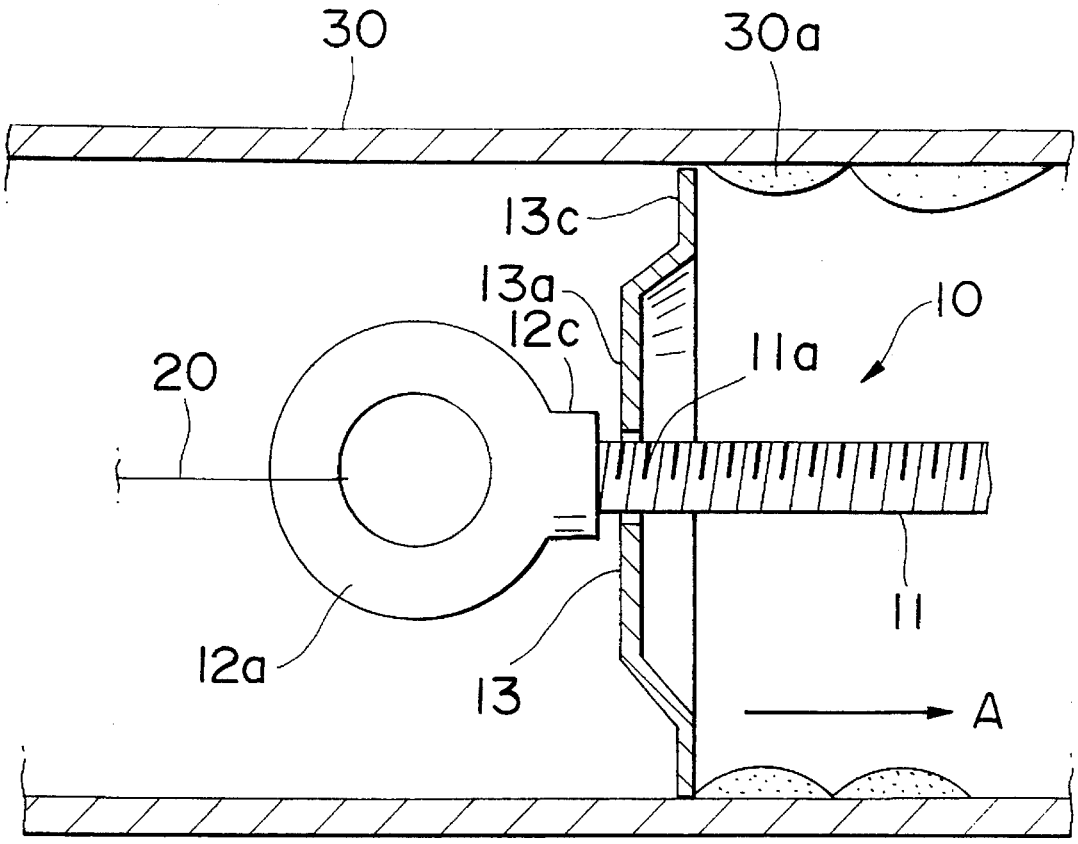
FIG. 5 is a view of the cleaning apparatus while it is removing rust inside the pipe.

A method for using the cleaning apparatus as described above will be described hereinbelow, with reference to accompanying drawings FIG. 2 and FIG. 4.

As shown in the drawings, the cleaning apparatus 10 of the present invention is moved inside the pipe 30 in the direction of arrow A by pulling the wire 20 which is connected with the knob 12*b*. If the disk-shaped portion 13*a* is located with its center of gravity to be closer to the flange portion 13*c* rather than to the disk-shaped portion 13*a*, it may be possible for the cleaning apparatus 13 to be inclined toward the flange portion 13*c*, as shown in FIG. 4. As a result, a clearance of predetermined dimension is created between the inner surface of the pipe 30 and the derusting disk 13, assuring that fine dust deposits may not collect upon the flange portion 13*c* in the pipe in an unreasonable amount during the movement of the apparatus.

When the cleaning apparatus moves and its outer flange portion 13*c* enters into contact with a rust deposit which projects into the pipe 30, the derusting disk 13 stops moving. Then the derusting disk 13 is caused to pivot about a contact point between the thread 11*a* formed on the guide 11 and the through-hole 13*d* to orient substantially a upright position. Since the guide 11 continues moving relative to the derusting disk 13 which has come to a standstill, the stop 12*c* which moves following the guide 11 is caused to collide with the derusting disk 13. Since the derusting disk 13 and the stop 12*c* are formed from metals such as iron, a sharp collision sound is generated at the occurrence of this collision. This collision sound is transmitted to an operator through the pipe 30, and thereby allowing him/her to know that the cleaning apparatus 10 has reached an area where rust deposits are present.

When this collision occurs, the stop 12*c* acts as a hammer relative to the derusting disk 13, and the rust which has built-up to protrude into the pipe 30 is removed by means of flange portion 13*c* under the impact of collision. If the rust 30*a* is not removed by the first collision, the operator manipulates the wire to move in an opposite direction for retracting the knob 12*a*, and then bring the stop 12*c* to move into collision against the disk portion 13*a*, and thereby making a derusting operation.

If this operation succeeds in eliminating a collision sound, an operator may appreciate that the rust has been completely removed. Once the rust 30 has been removed, the pipe interior cleaning apparatus of the present invention moves inside the pipe 30 with the derusting disk 13 in an inclined position.

Figure 6:
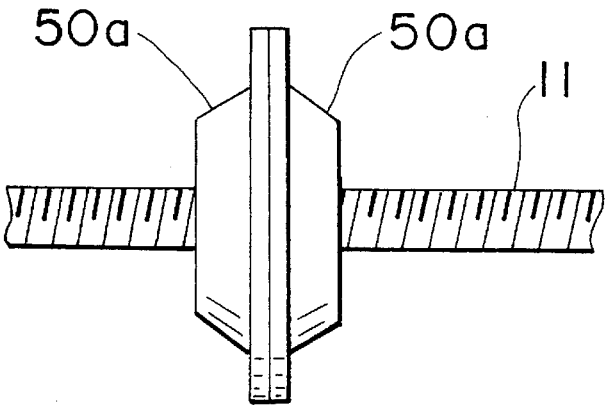
FIG. 6 is a view showing an alternative embodiment of the cleaning apparatus.

Though a single derusting disk is provided in this embodiment, it may be optionally possible to arrange a plurality of derusting disks 50*a* and 50*b* on the guide 11, as shown in FIG. 6.

In the above-described embodiment, the circumferential surface of the flange portion 13*c* of the derusting disk 13 is formed to be smooth and flat, but the surface may alternatively be formed in the configuration of, for example, serrations so as to improve the derustingeffect.

Figure 7:
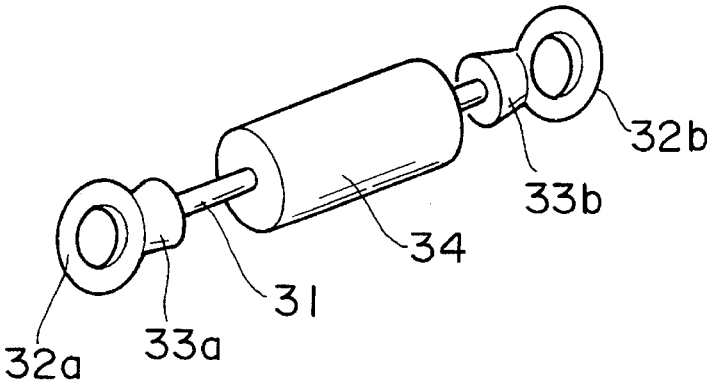
FIG. 7 is a perspective view of the cleaning apparatus of a second embodiment of the present invention.

The embodiment 2 will be described hereinbelow, with reference to FIG. 7. The cleaning apparatus 30 comprises a guide 31, ring-shaped knobs 32*a* and 32*b* each of which is provided at opposite ends of said guide 31 to be integral with stops 33*a* and 33*b*, and a cylindrical member 34 into which said guide 31 is inserted and which may slide along said guide 31 between said knobs 32*a* and 32*b*. The guide 31 extends axially through the cylindrical member. The cylindrical member 34 is cylindrical in shape similarly to a test mandrel to make it suitable for use in the continuity test. The cylindrical member is also made to be freely slidable relative to the guide 31.

The continuity test is carried out to examine the state prevailing inside the pipe, by moving a cylindrical member having a constant length and a diameter slightly smaller than that of the pipe inside the pipe. If the cylindrical member can pass smoothly through the pipe with no obstacle encountered, then it may be judged that the pipe is in a proper condition.

It has often experienced that the cylindrical member 34 is caught by the rust etc. which may build-up inside the pipe, thereby making it difficult to withdraw the member. In order to avoid such a state, the embodiment is arranged such that knobs 32*a* and 32*b* are caused to collide with the cylindrical member, to afford impact forces in the same way as that employed in the embodiment 1. The impact forces may serve to release the cylindrical member 34 from the rusts with no greater forces imposed.

Figure 8:
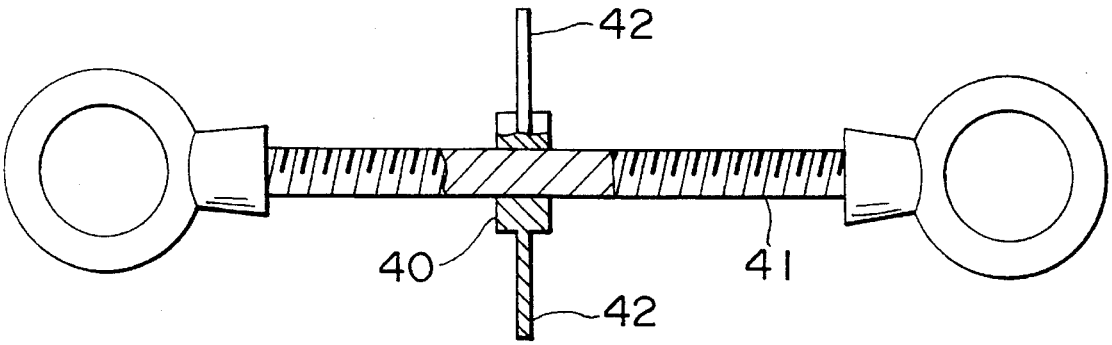
FIG. 8 is a perspective view of the cleaning apparatus of a third embodiment of the present invention.

The embodiment 3 will be described hereinbelow, with reference to FIG. 8. The derusting member 40 is formed in a disk-shaped configuration having a slightly increased thickness, and has the guide 41 inserted into the central portion thereof. A flange 42 is formed around a circumferential surface of this derusting member 40.

Contrary to the previous embodiment 1, the derusting member 40 in this embodiment is constantly oriented to a upright position without being forced to incline relative to the guide 41. Accordingly, the flange 42 can be formed in any arbitrary configuration that may correspond with the internal shape of the pipe.

This embodiment is identical with the embodiment 1 in otherwise aspects, and their methods of use are also identical with each other.

Figure 9:
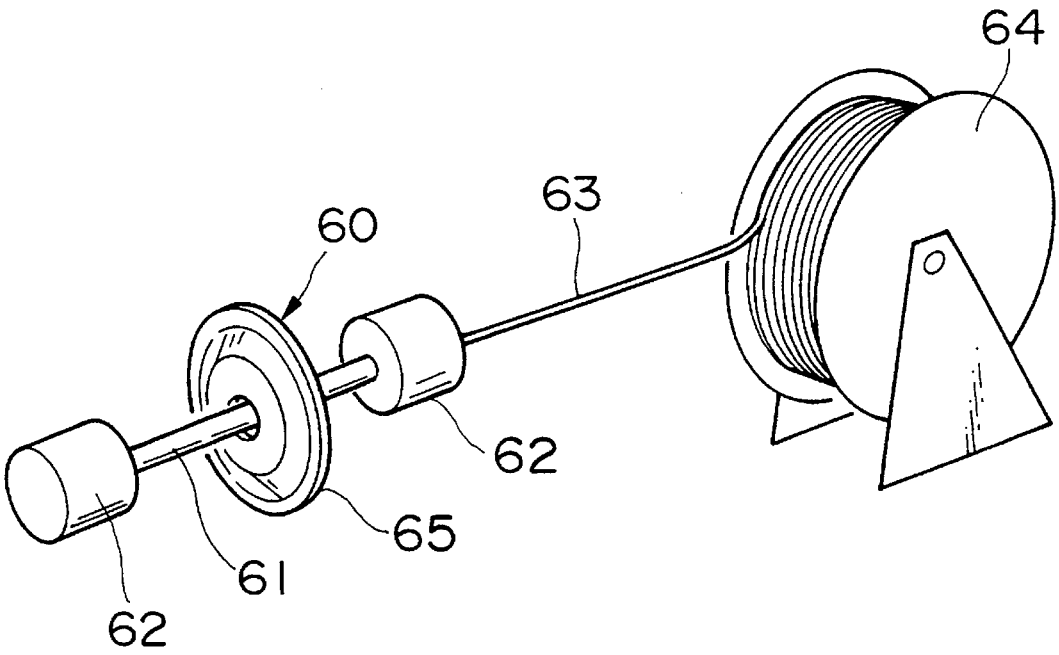
FIG. 9 is a front elevational view of the cleaning apparatus of a fourth embodiment of the present invention.
Figure 10:
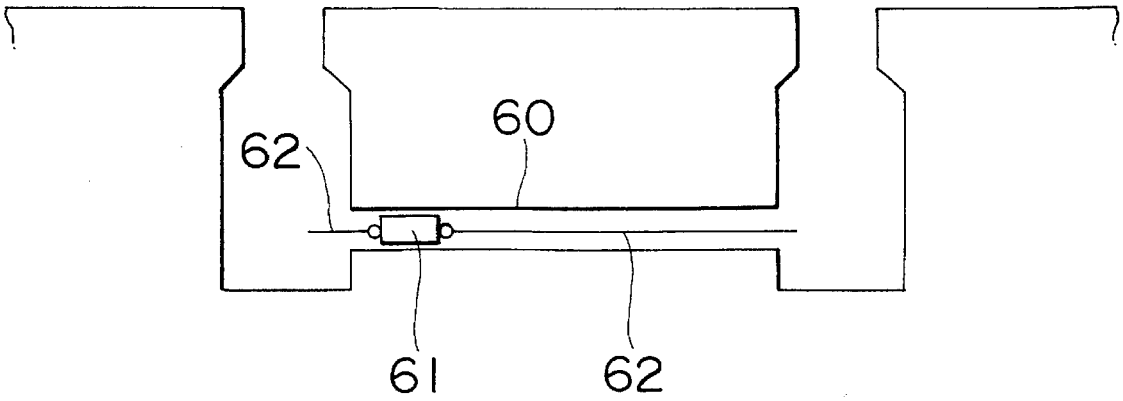
FIG.10 PRIOR ART
FIG. 10 is a reference view showing a prior art.

The embodiment 4 will be described hereinbelow, with reference to FIG. 9. The cleaning apparatus comprises a guide 61, a stop 62 which is provided at one end of said guide 61, and a derusting disk 65 into which said guide 61 is inserted. Said stop 62 is cylindrical in shape, and a similar stop 62 is also provided at an opposite end of the guide 61.

The stop 62 is provided at its tip end with a rope or line 63 which has a predetermined strength and is made bendable. This rope 63 is formed from a glass fiber, and wound around a coiling machine 64 with a suitable strength, and can be fed in a proper length as needed. The stops 62 and 62 may be formed in several alternative configurations other than cylindrical shape, including conical shapes etc.

This arrangement may permit an operator to insert the cleaning apparatus 60 through the pipe from one end of the pipe, without the need of jointing the wire at opposite ends of the pipe and taking related manipulations. Moreover, all operational sequences can be performed by a single operator, eliminating the need of manual work of jointing the wire.

Furthermore, even if the pipe is in a curved configuration, the glass fiber rope 63 can be bent to conform with this curved configuration. Thus, the apparatus 60 may find application in household uses including the cleaning of water supply lines. The cleaning apparatus of the invention is also available for use to remove water scales and other contaminations in addition to rusty deposits.

We claim:

1. A pipe interior cleaning apparatus for breaking off and moving obstacles on the bore surface of a pipe, the apparatus comprising:

(a) an elongated bar having a central longitudinal axis and having a central part and opposite ends along said axis, the central part being externally threaded, the threads being axially spaced outward extending projections which define the outer diameter of the bar, (b) a cleaning member comprising a body part with an outer edge and a generally central bore defining an inner edge, the bore diameter being greater than the outer diameter of said central part of the bar, (c) pulling means at each end of the bar for pulling the bar axially in the respective end directions, and (d) a stop fixed at each end of the bar axially inward of the pulling means, each stop having an outer diameter greater than that of the bar and greater than that of the bore diameter of said cleaning member, said bar extending through the bore of said cleaning member, said cleaning member when situated upright and generally perpendicular relative to the bar's longitudinal axis having both said outer edge and said inner edge situated respectively at their maximum lateral extension from said bar, (e) said cleaning member when oriented generally upright relative to the bar axis being easily axially movable along the length thereof, said cleaning member being inclinable relative to said upright orientation and when inclined having said lateral extension of its inner edge reduced such that said inner edge of the bore engages at least one of said outward extending projections, and subsequent axial movement of the bar drives the cleaning member similarly axially because of the engagement of said at least one of the projections with the inner edge of the bore.

2. The pipe interior cleaning apparatus of claim 1, wherein said pulling means comprises knobs.

3. The pipe interior cleaning apparatus of claim 1, wherein said cleaning member is provided on its outer circumferential surface with a flange.

4. The pipe interior cleaning apparatus of claim 1, wherein said cleaning member is formed around its outer circumferential portion with serrations.

5. The pipe interior cleaning apparatus of claim 1, wherein said pulling means and said cleaning member are formed from a metallic material.

6. Apparatus according to claim 1 wherein said bar is circular in cross-section and said cleaning member comprises a circular dish-shape with a central bore.

7. A pipe interior cleaning apparatus for breaking off and moving obstacles on the bore surface of a pipe, the apparatus comprising:

(a) an elongated bar having a central longitudinal axis and having a central part and opposite ends along said axis, the central part having a plurality of axially spaced outward extending projections thereon which define the outer diameter of the bar, (b) a cleaning member comprising a body part with an outer edge and a generally central bore defining an inner edge, the bole diameter being greater than the outer diameter of said central part of the bar, (c) pulling means at each end of the bar for pulling the bar axially in the respective end directions, and (d) a stop fixed at each end of the bar axially inward of the pulling means, each stop having an outer diameter greater than that of the bar and greater than that of the bore diameter of said cleaning member, said bar extending through the bore of said cleaning member, said cleaning member when situated upright relative to the bar's longitudinal axis having both said outer edge and said inner edge situated respectively at their maximum lateral extension from said bar, (e) said cleaning member, when oriented generally upright relative to the bar axis being easily axially movable along the full length thereof between said stops, said cleaning member being inclinable relative to said upright orientation and when inclined having said lateral extension of its inner edge reduced such that said inner edge of the bore engages at least one of said outward extending projections, and subsequent axial movement of the bar drives the cleaning member similarly axially because of the engagement of said at least one of the projections with the inner edge of the bore.

8. A pipe interior cleaning apparatus for breaking off and moving obstacles on the bore surface of a pipe, the apparatus comprising:

(a) an elongated bar having a central longitudinal axis and having a central part and opposite ends along said axis, and an outer surface defining an outer diameter thereof, (b) a dish-shaped cleaning member comprising a central body part with a generally central bore defining an inner edge, and an outer edge flange, the bore diameter being greater than the outer diameter of said central part of the bar, the cleaning member's center of gravity being closer to said flange then to said inner edge, (c) pulling means at each end of the bar for pulling the bar axially in the respective end directions, and (d) a stop fixed at each end of the bar axially inward of the pulling means, each stop having an outer diameter greater than that of the bar and greater than that of the bore diameter of said cleaning member, said bar extending through the bore of said cleaning member, said cleaning member when situated upright relative to the bar's longitudinal axis having both said outer edge and said inner edge situated respectively at their maximum lateral extension from said (e) said cleaning member, when oriented generally upright relative to the bar axis being easily axially movable along the length thereof, said cleaning member being inclinable relative to said upright orientation and when inclined having said lateral extension of its inner edge reduced such that said inner edge of the bore engages said outer surface of the bar, and subsequent axial movement of the bar drives the cleaning member similarly axially because of the engagement of the with the inner edge of the bore with the outer diameter of the bar.

9. A pipe interior cleaning apparatus for breaking off and moving obstacles on the bore surface of a pipe, the apparatus comprising:

(a) an elongated bar having a central longitudinal axis and having a central part and opposite ends along said axis, the central part being externally threaded, the threads being axially spaced outward extending projections which define the outer diameter of the bar, (b) a disk-shaped cleaning member comprising a body part with an outer edge and a generally central bore defining an inner edge, the bore diameter being greater than the outer diameter of said central part of the bar, (c) pulling means at each end of the bar for pulling the bar axially in the respective end directions, and (d) a stop fixed at each end of the bar axially inward of the pulling means, each stop having an outer diameter greater than that of the bar and greater than that of the bore diameter of said cleaning member, said bar extending through the bore of said cleaning member, said cleaning member when situated upright and generally perpendicular relative to the bar's longitudinal axis having both said outer edge and said inner edge situated respectively at their maximum lateral extension from said bar, (e) said cleaning member, when oriented generally upright relative to the bar axis being easily axially movable along the length thereof, said cleaning member being inclinable relative to said upright orientation and when inclined having said lateral extension of its inner edge reduced such that said inner edge of the bore engages at least one of said outward extending projections, and subsequent axial movement of the bar drives the cleaning member similarly axially because of the engagement of said at least one of the projections with the inner edge of the bore.

10. A pipe interior cleaning apparatus for breaking off and moving obstacles on the bore surface of a pipe, the apparatus comprising:

(a) an elongated bar having a central longitudinal axis and having a central part and opposite ends along said axis, the central part being externally threaded, the threads being axially spaced outward extending projections which define the outer diameter of the bar, (b) a dish-shaped cleaning member comprising a central body part with a generally central bore defining an inner edge, bore diameter being greater than the outer diameter of part of the bar, and a flange defining an outer edge, the cleaning member's center of gravity being closer to said flange than to said inner edge, (c) pulling means at each end of the bar for pulling the bar axially in the respective end directions, and (d) a stop fixed at each end of the bar axially inward of the pulling means, each stop having an outer diameter greater than that of the bar and greater than that of the bore diameter of said cleaning member, said bar extending through the bore of said cleaning member, said cleaning member when situated upright and generally perpendicular relative to the bar's longitudinal axis having both said outer edge and said inner edge situated respectively at their maximum lateral extension from said bar with said bore diameter being greater than the outer diameter of said central part of said bar, (e) said cleaning member, when oriented generally upright relative to the bar axis being easily axially movable along the length thereof, said cleaning member being inclinable relative to said upright orientation and when inclined having said lateral extension of its inner edge reduced such that said inner edge of the bore engages at least one of said outward extending projections, and subsequent axial movement of the bar drives the cleaning member similarly axially because of the engagement of said at least one of the projections with the inner edge of the bore.

* * * * *